US005319947A

United States Patent [19]

Fischer

[11] Patent Number: 5,319,947

[45] Date of Patent: Jun. 14, 1994

[54] BEVERAGE DISPENSER

[75] Inventor: Wolfgang Fischer, Conyers, Ga.

[73] Assignee: The Coca-Cola Company, Atlanta, Ga.

[21] Appl. No.: 117,263

[22] Filed: Sep. 3, 1993

[51] Int. Cl.[5] ..... B67D 5/62

[52] U.S. Cl. ..... 62/389; 62/459; 222/146.6

[58] Field of Search ..... 62/389, 390, 396, 397, 62/398, 399, 400, 459; 222/146.6, 129.1, 129.2, 129.3, 129.4

[56] References Cited

U.S. PATENT DOCUMENTS

| | | | |
|---|---|---|---|
| 678,368 | 7/1901 | Murphy . | |
| 1,243,068 | 10/1917 | Humphrey . | |
| 2,514,463 | 7/1950 | Bayers Jr. . | |
| 2,612,357 | 9/1952 | Parks . | |
| 4,148,334 | 4/1979 | Richards . | |
| 4,597,509 | 7/1986 | Pereira . | |
| 4,651,538 | 3/1987 | Bull et al. . | |
| 4,678,104 | 7/1987 | Pritchett . | |
| 4,888,961 | 12/1989 | McMichael | 62/389 |
| 4,960,228 | 10/1990 | Takahashi et al. . | |
| 4,979,647 | 6/1990 | Hassell . | |
| 5,115,942 | 3/1992 | Merrill et al. . | |
| 5,190,189 | 2/1993 | Zimmer et al. . | |
| 5,249,710 | 10/1993 | Hassell et al. | 62/398 |

OTHER PUBLICATIONS

Lancer "Valiant" Brochure © 1991.
Lancer "Royal" Brochure © 1987.
Wilshire Ice Cooled Drop-In Dispenser Brochure.

*Primary Examiner*—John M. Sollecito
*Attorney, Agent, or Firm*—Thomas R. Boston; W. Dexter Brooks

[57] ABSTRACT

An ice chest for a cold plate or drop-in type beverage dispenser wherein the cold plate includes a carbonator integral therewith and the ice chest also includes an aluminum casting as a side wall of the ice bin with prechill cooling coils embedded therein for prechilling the water before it is fed to the carbonator. The cold plate includes a semi-cylindrical sleeve extending downwardly therefrom and forming part of a carbonator housing. The sleeve is in intimate heat exchange contact with both the cold plate and the carbonator for cooling the carbonator.

8 Claims, 2 Drawing Sheets

BEVERAGE DISPENSER

BACKGROUND OF THE INVENTION

This invention relates to cold plate (or drop-in) type beverage dispensers.

Cold plate beverage dispensers often are installed with the carbonator located remote from the dispenser. The temperature of the water fed to the carbonator varies during the year, and along with long soda lines to the dispenser causes inconsistent carbonation levels. Installation of such a dispensing system is time consuming, and the long water lines and hook-ups create the potential for leaks.

Cold plate beverages dispensers are well-known. Carbonators used with such dispensers are also well-known. It is known that carbonating efficiency is a function of the temperature of the water; the cooler the water, the higher the carbonation.

SUMMARY OF THE INVENTION

An ice chest for a cold plate beverage dispenser including a carbonator integral with the cold plate. The cold plate is cast with an integral semi-cylindrical sleeve extending down below the cold plate. The carbonator is placed in the sleeve in intimate heat exchange contact therewith to cool the carbonator. The ice chest also includes an aluminum casting as a sidewall of the ice bin with water prechill cooling coils embedded therein. Water is fed from the water pump to the prechill coils and then to the carbonator for improved carbonation. The soda (carbonated water) is fed from the carbonator to the cold plate cooling coils and then to the dispensing valves of the dispensing tower located on top of the ice chest.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
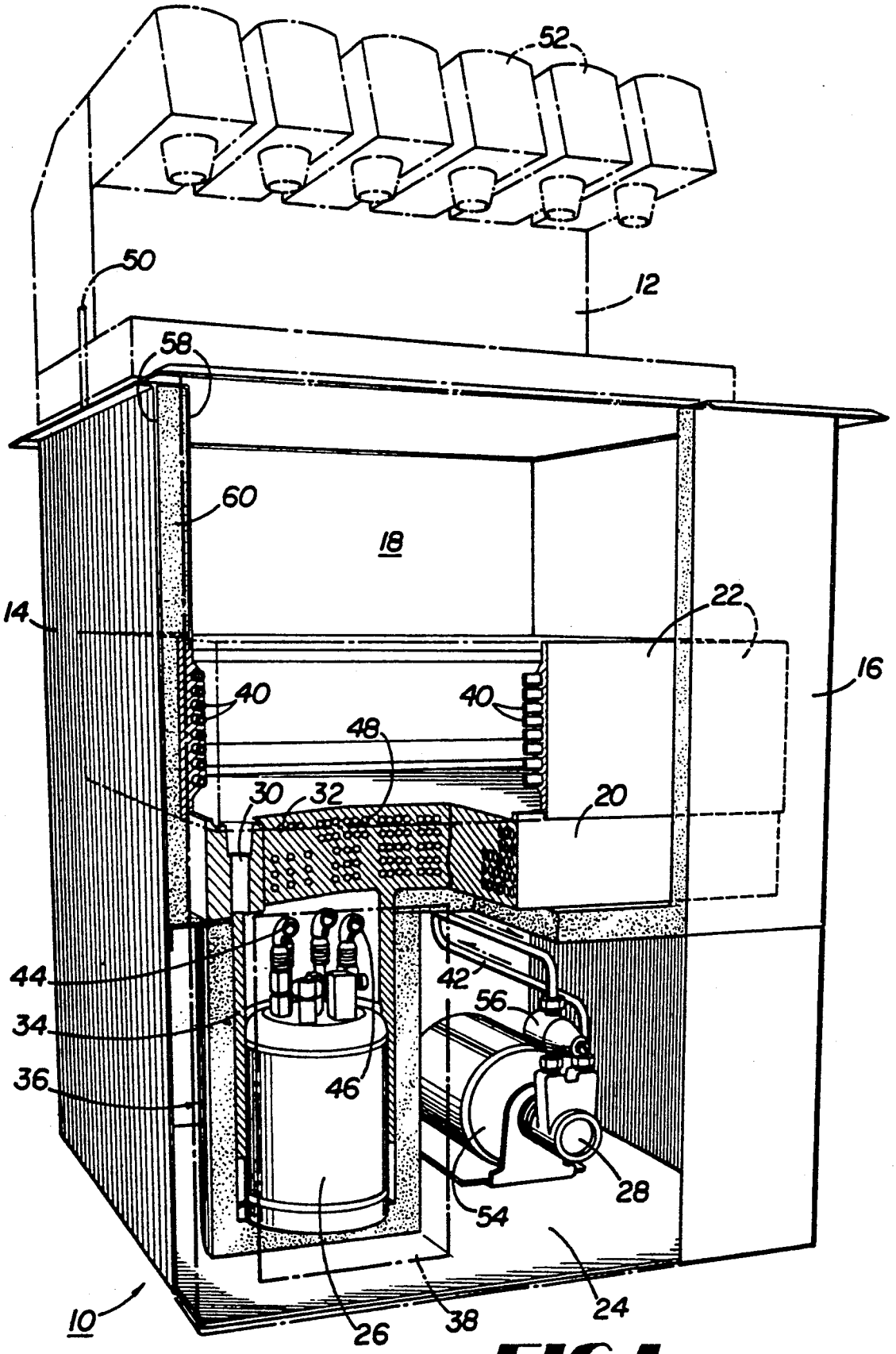
FIG. 1 is a perspective view, partly broken away, of the ice chest and dispenser of this invention.
Figure 2:
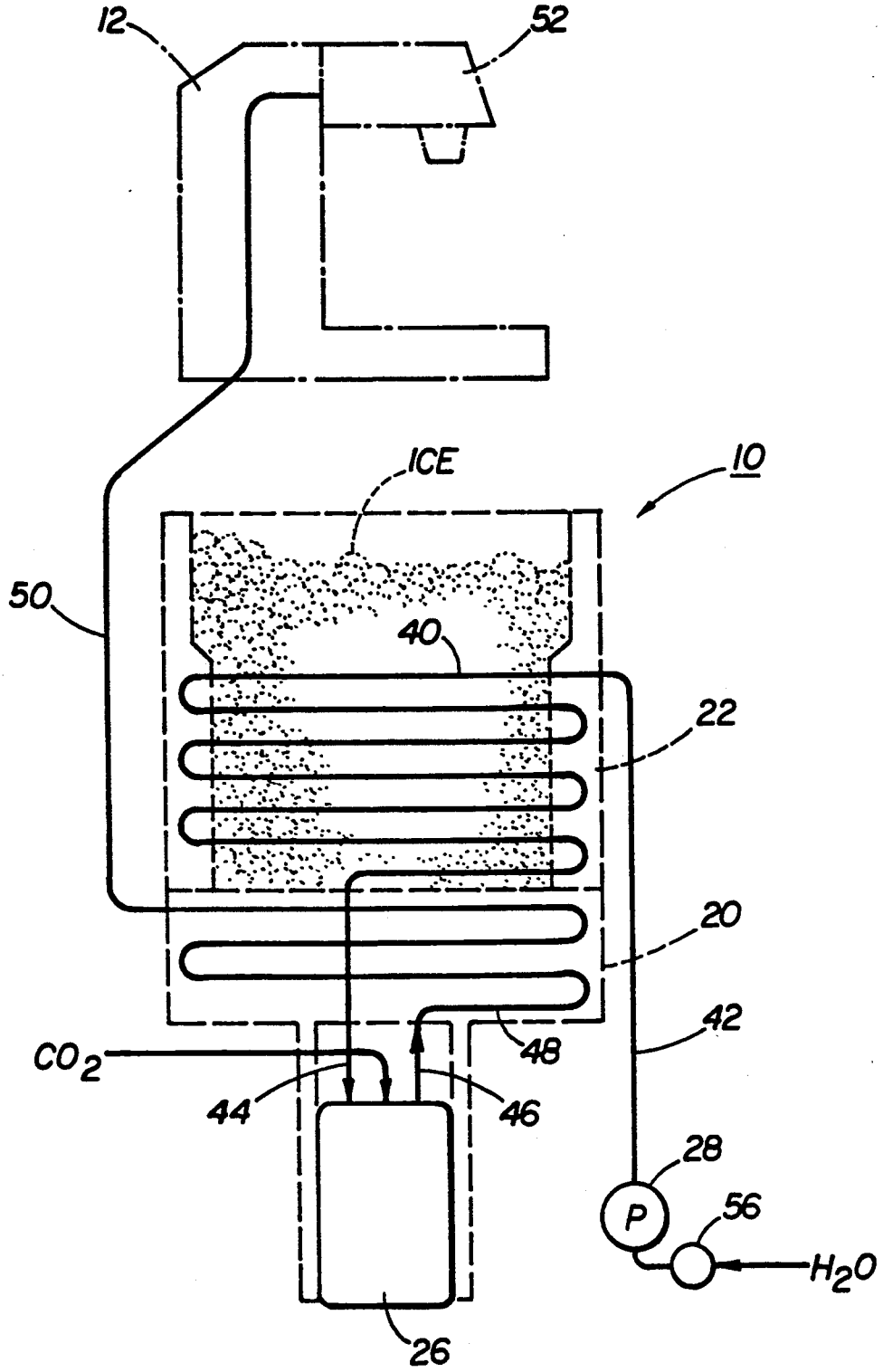
FIG. 2 is a partly diagrammatic, partly schematic view of the water flow through the ice chest of this invention.

With reference now to the drawings, FIGS. 1 and 2 show a cold plate beverage dispenser 10 including a tower 12 and the ice chest 14 of the present invention.

The ice chest 14 includes a cabinet 16 enclosing an ice bin 18 having an aluminum cold plate 20 as its bottom wall and an aluminum casting 22 as a portion of its sidewall. The cold plate 20 is spaced above a bottom panel 24 of the cabinet providing a space in which a carbonator 26 and a water pump 28 are located.

The cold plate 20 includes a drain 30 and a plurality of cooling coils 32 embedded therein as is well-known. For example, there may be eight syrup coils, two soda coils, and one sweet water coil. However, according to the present invention, the cold plate also includes a semi-cylindrical aluminum sleeve 34 formed as an integral part thereof and extending downwardly therefrom to form part of a carbonator housing 36. The carbonator 26 is cylindrical and the sleeve 34 is in intimate heat exchange contact with both the carbonator and the cold plate, thus cooling the carbonator by conduction. The sleeve is surrounded with heat insulation, which also forms the remainder of the carbonator housing 36. The housing 36 includes a front, removable access panel 38, which can be reached after removing a front access panel (not shown) from the cabinet 16.

The aluminum casting 22 includes a prechill water cooling coil 40 embedded therein with preferably eight turns. As shown in FIG. 2, inlet (city) water is fed to the pump 28, then a first water line 42 goes from the pump to the prechill coil 40, a second water line 44 goes from the prechill coil 40 to the carbonator 26, a first soda line 46 goes from the carbonator to a soda cooling coil 48 in the cold plate 20, and then a second soda line 50 goes from the cold plate to a dispensing valve 52 in the tower 12.

The water pump 28 includes an electric motor 54 and a water pressure regulator 56. The wall panels 58 of the cabinet are preferably stainless steel with structural foam insulation 60 therebetween.

The ice chest 14 of this invention provides a cold plate with an integral carbonator. The advantages of this invention increased cup carbonation, improved equipment reliability, decreased installation time and cost, and consistent carbonation levels that are immune to incoming water temperature variations. Increased cup carbonation will result in overall drink quality improvement. This integral carbonator will significantly decrease installation time because of the simplified hook-up; only plumbing water, syrup and $CO_2$ are necessary. No additional lines from a separate carbonator are required, therefore providing less leak potential. This simplified system also improves overall equipment reliability. The ability to provide stable (and high) carbonation levels regardless of incoming water temperature variation is a significant advantage. The pre-cool coil casting 22 provides adequate cooling for 95° F. ambient performance. This assembly provides approximately 55 feet of ⅜" tubing in an aluminum casting having 2.5 square feet of ice contact area. This tubing is located around the perimeter of the ice bin 18 and consists of preferably eight turns. The carbonator 26 is equipped with quick disconnect fittings to enable easy removal of the carbonator for field service access to components. The carbonator 26 is cooled via conduction which utilizes the cooling capacity of the cold plate 20 while the unit is idle and filled with ice.

While the preferred embodiment of this invention has been described above in detail, it is to be understood that variations and modifications can be made therein without departing from the spirit and scope of the present invention. For example, the aluminum carbonator sleeve need not be cast as an integral part of the cold plate. It can alternatively be a separate element and subsequently connected to the cold plate in intimate heat exchange contact. The prechill coil casting can be larger or smaller and can be cast as an integral part of the cold plate or can be made separately as shown and as preferred.

What is claimed is:

1. An ice chest for a cold plate type beverage dispenser comprising:

(a) said ice chest including a cabinet, an ice bin in said cabinet formed by a bottom wall and a sidewall, said bottom wall being an aluminum ice-cooled cold plate having a plurality of syrup cooling coils and a soda cooling coil embedded therein, said sidewall including an aluminum casting having a water prechill cooling coil embedded therein;

(b) a carbonator and a water pump located in said ice chest below said cold plate;

(c) a first water line extending from said water pump to said prechill coil, a second water line extending from said prechill coil to said carbonator, a first soda line extending from said carbonator to said soda cooling coil;

(d) a carbonator housing enclosing a carbonator chamber therein, said housing being located directly below said cold plate and including an aluminum sidewall in intimate heat exchange contact with said cold plate; and (e) said carbonator being located in said carbonator chamber of said housing and being in intimate heat exchange contact with said sidewall of said carbonator housing.

2. The ice chest as recited in claim 1 wherein said carbonator is cylindrical and said aluminum sidewall is semi-cylindrical and is in intimate heat exchange contact with a portion of said carbonator, and said housing includes an insulating sidewall enclosing the remaining portion of said carbonator.

3. The ice chest as recited in claim 1 wherein said aluminum sidewall of said carbonator housing is cast integrally with said cold plate.

4. The ice chest as recited in claim 1 wherein said prechill coil includes eight turns.

5. The ice chest as recited in claim 1 wherein said cabinet includes a bottom panel adapted to sit adjacent a floor, and said cold plate is spaced apart above said bottom panel a sufficient distance to provide room for said carbonator and said water pump.

6. The ice chest as recited in claim 5 wherein said water pump includes an electric motor and a water pressure regulator.

7. The ice chest as recited in claim 1 including heat insulation surrounding said aluminum sidewall of said carbonator housing.

8. The ice chest as recited in claim 1 including a beverage dispensing tower located on top of said ice chest.

* * * * *

UNITED STATES PATENT AND TRADEMARK OFFICE

CERTIFICATE OF CORRECTION

PATENT NO. : 5,319,947

DATED : June 14, 1994

INVENTOR(S) : Wolfgang Fischer et al.

It is certified that error appears in the above-identified patent and that said Letters Patent is hereby corrected as shown below:

In the Title Page, at [75] Inventor:, after "Ga.", insert --; Geoffery M. Coulborn, Roswell, Ga.; Ronald E. Grimm, Duluth, Ga.; Thomas G. North III, Woodstock, Ga.; Daniel S. Quartarone, Stone Mountain, Ga.; and Roger C. Whigham, Atlanta, Ga.--.

Item [19], add "et al"

Signed and Sealed this

Twenty-third Day of May, 1995

*Attest:*

Bruce Lehman

BRUCE LEHMAN

*Attesting Officer*

*Commissioner of Patents and Trademarks*